United States Patent [19]

Morgan

[11] 4,064,721

[45] Dec. 27, 1977

[54] SECURITY LOCK FOR DEAD-BOLT DOOR LOCKS

[75] Inventor: Robert H. Morgan, Milwaukee, Wis.

[73] Assignee: Richard V. Marsek, Wauwatosa, Wis. ; a part interest

[21] Appl. No.: 730,619

[22] Filed: Oct. 7, 1976

[51] Int. Cl.[2] ..... E05B 17/00

[52] U.S. Cl. ..... 70/416; 70/431; 70/DIG. 58

[58] Field of Search ..... 70/416, 431, 447, 211, 70/212, DIG. 58

[56] References Cited

U.S. PATENT DOCUMENTS 1,956,388 4/1934 Kalina ..... 70/416

*Primary Examiner*—Robert L. Wolfe

*Attorney, Agent, or Firm*—Ira Milton Jones

[57] ABSTRACT

A security locking device for dead-bolt door locks which is distinguished by a shroud that encompasses and grips the dead-bolt actuator at the inside of the door, and is rotatably mounted in a base secured to the inner face of the door, with a handle portion on the shroud exposed to enable the shroud — and hence the dead-bolt actuator — to be manually turned. A spring biased security bolt slidably mounted in the base engages a cylindrical side surface of the shroud and snaps into a keeper recess in that surface when the shroud is turned to the position at which the dead-bolt is in its projected door-locking position. A manually rotatable cylinder with an eccentric lug at its inner end to engage one or the other of a pair of opposing shoulders on the security bolt is mounted in the base and operable from inside the door to enable retraction of the security bolt and to selectively hold the security bolt in either its projected operative position or its retracted inoperative position. A similar security bolt control is provided at the outside of the door, but in this case it is in the form of a key controlled lock cylinder which, in its locked position, holds the security bolt in its projected operative position to prevent unauthorized opening of the door, even from the inside, and when turned from its locked position, retracts the security bolt to free the adjacent exterior dead-bolt actuator for the rotation needed to retract the dead-bolt.

12 Claims, 4 Drawing Figures

Fig. 1
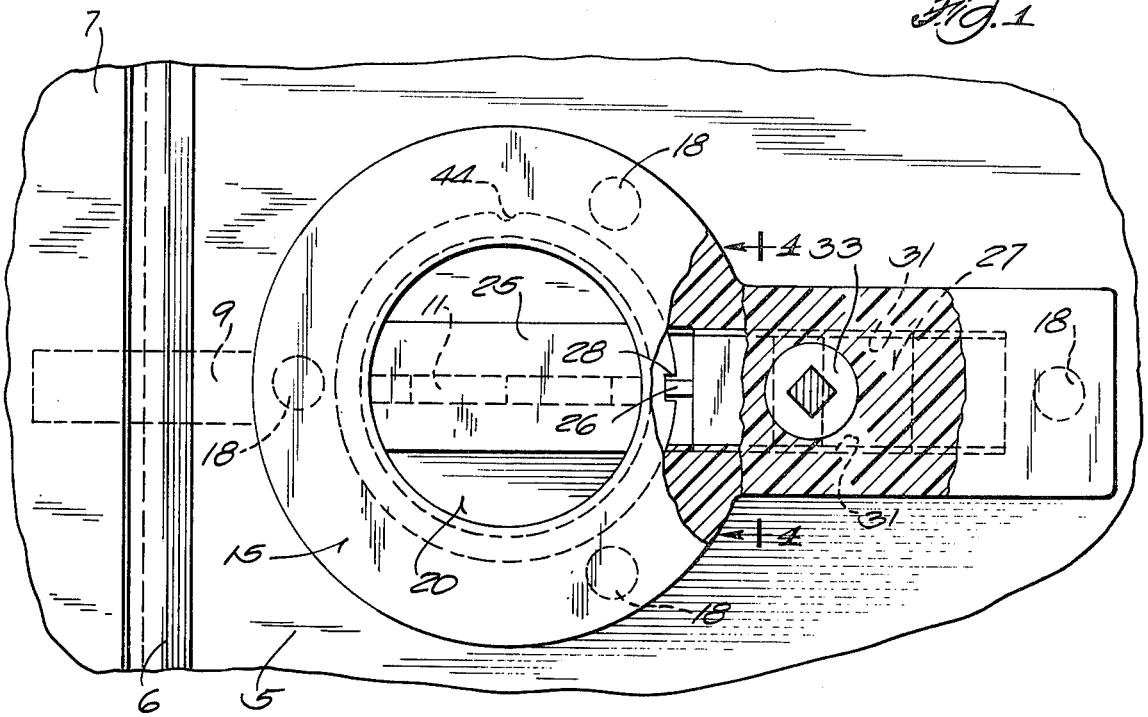
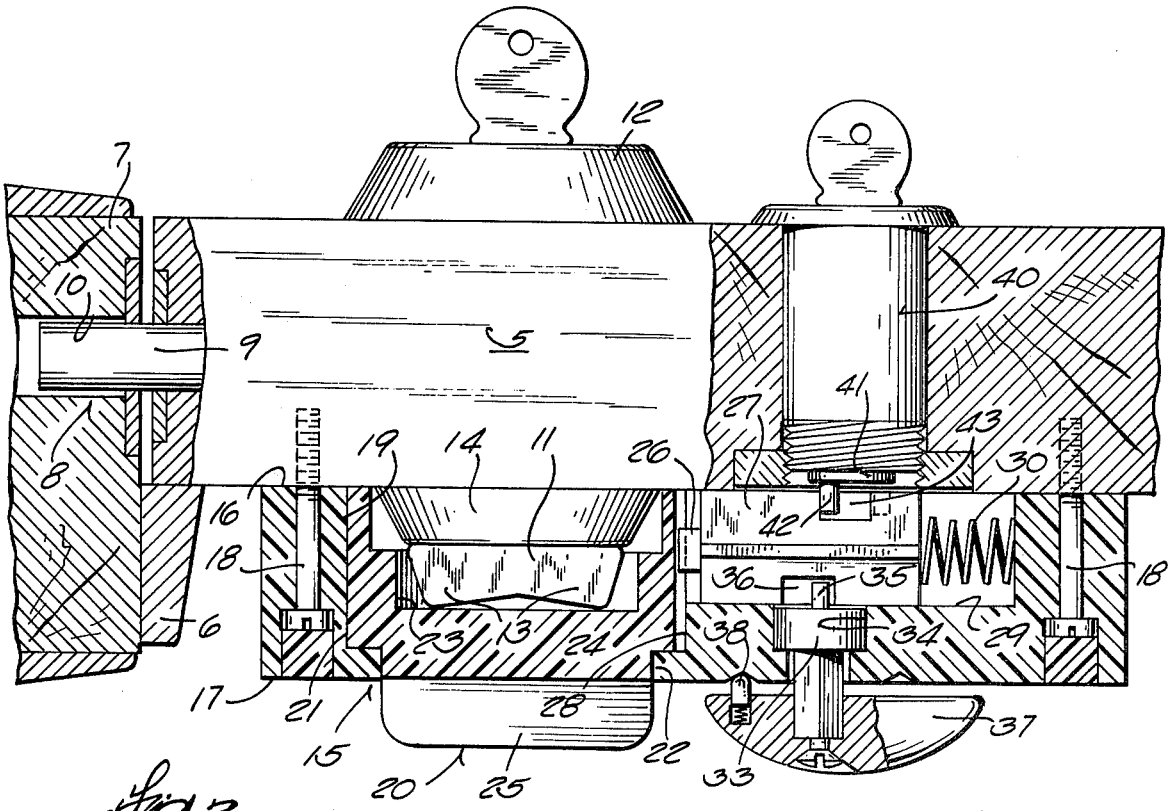
Fig. 2

SECURITY LOCK FOR DEAD-BOLT DOOR LOCKS

This invention relates generally to door locks and refers more particularly to a security device by which a conventional dead-bolt door lock can be dependably prevented from bolt retracting actuation.

The entrance doors of homes, apartments, offices and hotel rooms are customarily provided with dead-bolt locks in addition to the regular key controlled locks. In a dead-bolt lock, rotation in one direction, of an actuator - which is often referred to as a thumb knob and is located at the inside of the door projects the bolt from the free edge of the door into a keeper recess in the adjacent portion of the door frame, and when rotated in the opposite direction, retracts the bolt. To provide for projection and retraction of the bolt from outside of the door, a key controlled tumbler lock mounted on the outer face of the door is operatively connected with the bolt to project the same to its operative door locking position upon rotation of the key in one direction, and to retract the bolt upon rotation of the key in the opposite direction.

Since any tumbler lock is vulnerable to being picked or opened with a pass-key, even a dead-bolt door lock cannot be relied upon to prevent unauthorized entry. When that happens there is no evidence of "breaking and entering" and, as a result, any loss that occurs from such unauthorized entry would not normally be covered by theft or burglary insurance.

This dilemma has spawned a host of security devices by which the dead-bolt actuator, or thumb knob, at the inside of the door can be held against rotation, since retraction of the bolt cannot take place without concomitant rotation of that actuator.

Examples of these security devices will be found in U.S. Pat. Nos: 3,862,556; 3,826,117; 3,748,882; 3,423,974 and 1,700,135.

While some of these prior locking devices did afford some increased assurance against unauthorized opening of a dead-bolt lock, no really dependable solution to the problem is known to have existed heretofore.

One of the shortcomings of prior security devices for dead-bolt door locks was the necessity for taking some action in addition to turning the actuator or thumb knob to project the bolt to its locking position, before the device was activated. Usually the part which engaged the thumb knob to prevent its rotation had to be swung or moved from an inoperative position into engagement with the thumb knob after the latter was turned to project the bolt to its locking position. If that was not done, the security device might just as well not have been installed.

By contrast, one of the features of this invention is that its thumb knob securing part is at all times drivingly connected with the thumb knob, and is automatically secured against rotation to prevent retraction of the dead-bolt the instant that bolt reaches its projected door locking position.

By another feature of this invention, the dead-bolt can be locked in its projected door locking position from outside the door. This capability provides assurance that thieves masquerading as movers and gaining entry through some hidden-from-view opening — as, for instance, a rear window — would not be able to open the door and boldly carry out the contents of the home without arousing the suspicions of the neighbors.

Still another achievement of this invention is the embodiment of its working parts in an attractive unitary structure that is easily installed on a door.

It follows, therefore, that the object and purpose of this invention is the provision of an improved, thoroughly dependable and aesthetically attractive security locking device for dead-bolt door locks.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of the embodiment of the invention constructed according to the best mode so far devised for the practical application of the principles thereof, and in which:

FIG. 1 is a front view of the security locking device of this invention, with a portion thereof broken away to illustrate certain details;

FIG. 2 is a horizontal sectional view through the locking device and partially through the door on which it is mounted and through the adjacent part of the door frame, with the security bolt of the locking device locked against retraction from its dead-bolt securing position except by its key-controlled actuator on the outside of the door;

Figure 3:
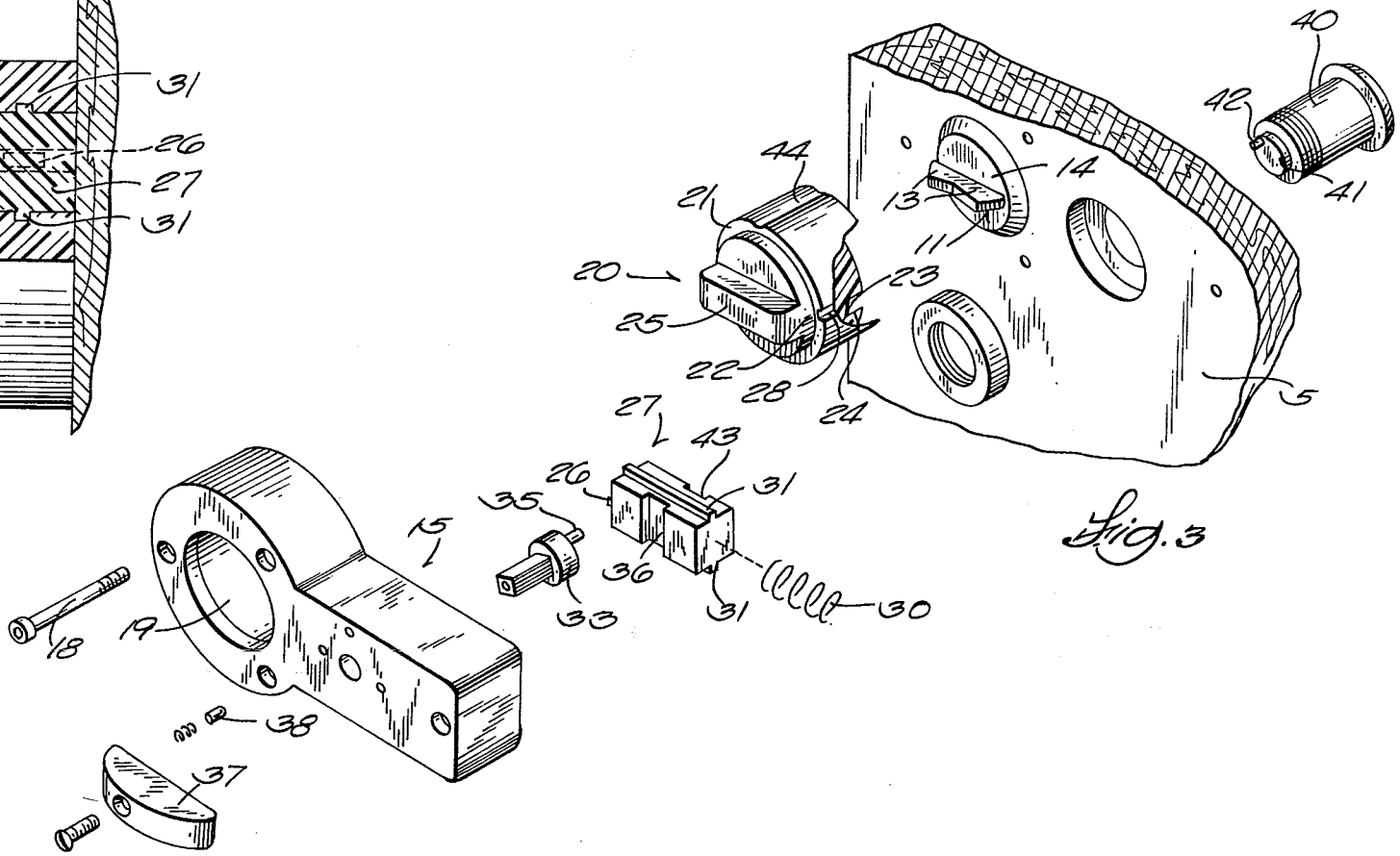
FIG. 3 is an exploded perspective view of the component parts of the security locking device.
Figure 4:
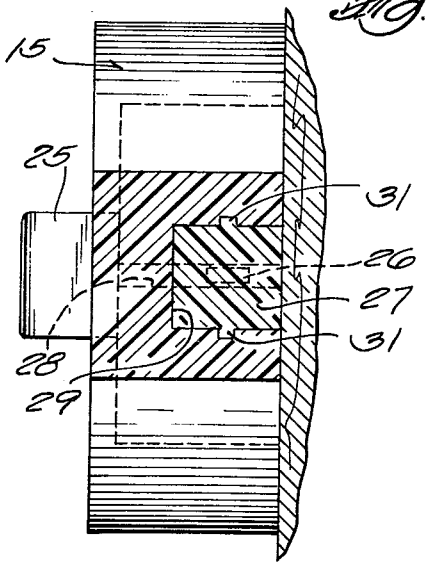
FIG. 4 is a cross sectional view through FIG. 1 on the plane of the line 4—4.

Referring to the drawings, the numeral 5 designates the door to be locked, only a part of its free edge portion being illustrated. As will be understood, the door is hingedly mounted to swing to and from a closed position in which its free edge bears against a stop 6 which forms a part of the door frame 7. The door is equipped with the usual inside and outside knobs, neither of which is illustrated, by which the usual spring projected latch (also not shown) is retracted to permit opening the door.

In addition to its spring projected latch, the door is equipped with a conventional dead-bolt lock, indicated generally by the numeral 8, and consisting of a bolt 9 and mechanism for projecting the bolt into and retracting it from a keeper recess 10 in the door frame. That mechanism, being conventional, has not been illustrated, but as is customary it is operable by a non-circular actuator or thumb knob 11 at the inside of the door and a key-controlled lock 12 at the outside of the door.

For the purposes of this invention, it should be noted that while the specific design of the actuator or thumb knob 11 at the inside of the door may vary with different dead-bolt locks, in every case it is non-circular to enable rotation to be manually imparted to it. In the illustrated lock, the actuator or thumb knob 11 has a pair of diametrically opposite flat surfaced wings 13 projecting from its base portion which overlies a circular escutcheon 14.

The structure thus far described is entirely conventional and representative of all dead-bolt door locks, and — of that structure — its actuator or thumb knob 11 constitutes the part with which the security lock of this invention coacts. To that end, the invention contemplates the provision of a base 15 that is preferably an injection-molded plastic part having opposite inner and outer faces 16 and 17, the former at least being flat to have surface-to-surface engagement with the door to which it is secured, as by screws 18.

A round hole 19 extending through the base 15 has a shroud 20 rotatably received therein. This shroud is a two-diameter cylinder with large and small diameter end portions 21 and 22, respectively, that have a snug but freely rotatable fit in correspondingly dimensioned end portion of the hole 19. The large diameter end portion of the hole 19 opens to the inner face 16 of the base, so that the shroud is assembled with the base from that face and is held against axial displacement when the base is in position on the door, by being confined between the step in the side wall of the hole 19 and the adjacent side of the door.

The cylindrical shroud has a torque transmitting connection with the actuator or thumb knob 11, formed by the reception of the latter in a correspondingly shaped and dimensioned inner portion 23 of a socket 24 in the shroud, the outer portion of which receives the escutcheon 14. It is therefore possible to impart bolt projecting and retracting rotation to the actuator or thumb knob 11 by turning the shroud, and to facilitate the latter, a wing or rib 25 extends diametrically across the outer end of the shroud.

Since the shroud 15 completely encompasses the actuator or thumb knob 11, the only way in which the bolt 9 can be projected and retracted from inside the door is by rotation of the shroud. The significance of this observation will become apparent as the description proceeds; but, before going on, it should be recalled that unless the actuator or thumb knob 11 is free to turn, the bolt 9 cannot be retracted, or — for that matter — projected from outside the closed door, even though the would-be entrant has the proper key for the lock 12. And, since the actuator or thumb knob 11 cannot turn independently of the shroud, it follows that securement of the shroud against rotation from the position it occupies when the bolt is projected, effectively locks the door against unauthorized opening.

The shroud is securable against rotation from its bolt-projecting position by the entry of a finger 26 projecting from the front end of a security bolt 27 into a keeper recess 28 in the cylindrical side wall of the shroud. The security bolt 27, like the base 15 and the shroud, is preferably a projection-molded part, and in the illustrated embodiment of the invention is an oblong block that is square in cross section and slidably received in a correspondingly shaped and dimensioned groove 29 formed in the base and opening to the inner face thereof. The inner end of this groove opens into the hole 19 in the base to enable the finger 26 of the security bolt to bear against the adjacent cylindrical side wall of the shroud and snap into the keeper recess 28 when the shroud reaches the position of rotation it occupies when the bolt 9 is in its operative projected position. It should be noted that the side walls of the keeper recess 28 are flat and parallel and that the entrance to this recess is sharply defined, so that upon entry of the finger 26 of the security bolt — which likewise has flat opposite sides — into the keeper recess, torque applied to the shroud cannot displace the security bolt from its operative position. A spring 30 confined between the rear end of the security bolt and the adjacent closed end of the groove 29, yieldingly biases the security bolt towards its operative position.

Although the security bolt 27 is confined to the groove 29 in the base when the latter is in position on the door, it is preferable to provide the opposite side walls of the groove 29 with longitudinal ribs or ridges 31 which slidably ride in guideways 32 formed in the side walls of the bolt 27. By virtue of the slight elasticity of freshly made injection-molded plastic parts, the presence of such ribs or ridges on the side walls of the groove 29 presents no problem, but to permit assembly of the bolt 27 with the base, the length of the bolt must not exceed the diameter of the hole 19.

Since the security bolt 27 automatically locks the shroud in the position of rotation it occupies when the dead-bolt 9 is in its projected position, it is of course necessary that there be means for retracting the security bolt, both from inside and outside the door. At the inside of the door this requirement is fulfilled by the provision of a manually rotatable cylinder 33 that is freely rotatably confined in a hole 34 in the base. The hole 34 opens into the groove 29, and the inner end of the cylinder is directly contiguous to the adjacent side of the security bolt to enable an eccentric driving lug 35 projecting from the cylinder to enter a notch or recess 36 extending transversely across the security bolt, to provide a pair of opposing shoulders with which the lug 35 coacts.

The width of the notch or recess 36 and its location with respect to the finger 26 and to the throw of the eccentric driving lug 35, which is of course determined by the diameter of its circular orbit, are such that by 90° rotation of the cylinder 33 in one direction from the neutral position in which it is shown in FIG. 2, the security bolt is held against retraction from its operative position locking the shroud — and hence the actuator or thumb knob 11 — against rotation; and upon 90° of cylinder rotation in the opposite direction from its neutral position, the security bolt is held in its retracted inoperative position in which it cannot interfere with rotation of the shroud. In the neutral position of the cylinder, its eccentric driving lug does not prevent movement of the security bolt in either direction.

A handle 37 secured to a square stem projecting from the outer end of the cylinder 33 enables the cylinder to be turned; and a spring-pressed detent 38 in this handle coacts with three sockets in the outer face of the base to identify the three positions of the cylinder 33.

At the outside of the door a key-controlled tumbler lock 40 provides means by which the spring biased security bolt may be retracted and optionally locked in its projected position. For this purpose, the cylinder 41 of this lock has an eccentric driving lug 42 projecting into a notch or recess 43 in the adjacent side of the security bolt to provide an operative connection between the lock and the bolt similar to that which exists at the inside of the door between the cylinder 33 and the bolt. Accordingly, the security bolt can be locked in its projected operative position as well as retracted from that position from the outside of the door, but since the key of the lock 40 can be withdrawn only when its cylinder 41 is either in its locked or neutral positions, the security bolt can not be secured in its retracted position from the outside.

Inasmuch as the security bolt can be locked in its projected position from outside the door, it follows that a thief hoping to carry the contents of a home through the open front door by posing as a legitimate mover, and gaining entry through a window or in some other unobservable way, would be thwarted by the inability to retract the security bolt from the inside.

Authorized entry requires the use of two keys, one in the lock 40 to retract the security bolt and the other in the lock 12 to retract the dead-bolt 9. The first key (in the lock 40) must be turned far enough to retract the security bolt from engagement in the keeper recess 28 in the shroud, but since that key cannot be removed except in the locked or neutral position of its lock cylinder, the authorized entrant must turn the second key (in the lock 12) preferably far enough to fully retract the dead-bolt, before he turns the first key back to its neutral position for removal.

The fully retracted position of the dead-bolt is identified by entry of the finger 26 on the security bolt into a shallow round-bottomed groove 44 in the side wall of the shroud, 90° removed from the keeper recess 28. Because of the shallow round-bottomed formation of the groove 44 its reception of the finger 26 is in the nature of a detent which does not prevent intentional rotation of the shroud.

Those skilled in the art will appreciate that the invention can be embodied in forms other than as herein disclosed for purposes of illustration.

The invention is defined by the following claims:

1. A locking device for preventing unauthorized retraction of the bolt of a dead-bolt door lock of the type wherein rotation of a key controlled actuator at the outside of the door and of a non-circular manual actuator at the inside of the door selectively effects projection or retraction of the dead bolt, depending in each instance upon the direction or rotation, said locking device comprising:

A. a base having
   1. opposite inner and outer faces,
   2. a round hole therethrough opening to both of said faces, and
   3. a straight sided guideway that is substantially radial to the axis of said round hole and at one end thereof opens into said hole;

B. a shroud having an axis, rotatably seated in said round hole with its axis intersecting said inner and outer faces of the base and the axially opposite ends of the shroud accessible at said faces,
   said shroud also having a keeper recess in a peripheral side surface thereof;

C. a socket in the end portion of the shroud that is accessible at the inner face of the base, said socket being of a size and shape to receive and fit said non-circular manual actuator of a dead-bolt lock with which the locking device is associated, so that said non-circular manual actuator may be turned by rotating the shroud, the keeper recess in the peripheral side surface of the shroud being aligned with said guideway when the shroud is in its position of rotation at which the dead-bolt is in its projected position;

D. means at the end portion of the shroud that is accessible at the outer face of the base by which rotation can be imparted to the shroud;

E. means for securing the base to the inside of the door with the shroud covering and drivingly connected with said non-circular manual actuator;

F. a security bolt slidably received in said guideway in the base for movement between a projected operative position engaging said peripheral side surface of the shroud and a retracted inoperative position disengaged from said peripheral side surface of the shroud;

G. spring means biasing the security bolt towards its projected operative position so that, when free to be moved by said spring means, the security bolt snaps into the keeper recess in said peripheral side surface of the shroud upon rotation of the shroud to its position at which the dead bolt is in its operative position;

H. a control member for the security bolt selectively movable to a plurality of defined positions; and I. drive means operatively connecting the control member with the security bolt and through which the operativeness of the security bolt is governed by selective positioning of the control member.

2. The locking device of claim 1, wherein said shroud and said hole are of mutually stepped diameter with the largest diameter at the inner face of the base, so that in assembling the shroud with the base the shroud is inserted into the hole from the inner face of the base and securement of the base to the door confines the shroud axially between the door and a step separating two adjacent different diameters of the hole from one another.

3. The locking device of claim 1, wherein said guideway has opposite flat parallel sides;

wherein said security bolt is an oblong block with two opposite flat parallel sides slidably engaging said sides of the guideway;

and further characterized by interengaging means on the slidably engaging sides of the guideway and the oblong block constraining the block to straight-line motion.

4. The locking device of claim 1, wherein said control member is on the base and hence at the inside of the door, wherein the defined positions of the control member are 1. a first extreme position,
2. a second extreme position, and
3. an intermediate position, wherein movement of the control member to its first extreme position acting through said drive means moves the security bolt to and holds it in its retracted inoperative position, wherein movement thereof to its second extreme position also acting through said drive means holds the security bolt in its projected operative position, and wherein movement of the control member to its intermediate position permits the security bolt to be impositively maintained by said spring means in its projected operative position.

5. The locking device of claim 4, further characterized by:

A. key controlled motion producing means arranged to be accessible at the outside of the door on which the locking device is installed, and B. drive means operatively connecting said key controlled motion-producing means with the security bolt and through which actuation of said key controlled motion producing means can retract the security bolt from its projected operative position unless the manual control member at the inside of the door is in its second extreme position.

6. The locking device of claim 4, further characterized by cooperating detent means on the base and said control member to define the three positions of the control member and releasably hold the same in any selected one of them.

7. The locking of claim 1, wherein said control member is mounted on the base and hence at the inside of the door on which the locking device is installed, further characterized by key controlled motion-producing means arranged to be accessible at the outside of the door on which the locking device is installed, and drive means operatively connecting said key controlled means with said security bolt by which, upon proper actuation of said key controlled means, the security bolt may be retracted from its projected operative position unless, by selected positioning of the control member, the security bolt is held against retraction from the outside of the door.

8. The locking device of claim 6, wherein said drive means operatively connecting the key-controlled means with the security bolt, also comprises means by which, upon proper actuation of said key controlled means, the security bolt may be locked against retraction from its operative position.

9. The locking device of claim 8, wherein said security bolt is an axially slidable oblong member, one end of which is shaped to engage in said keeper recess in the shroud, wherein said key controlled motion producing means comprises a rotatable lock cylinder, and wherein said drive means connecting the key controlled motion producing means comprises an eccentric driving lug projecting from said lock cylinder into a recess in said oblong member, the dimensions of said recess and its location with respect to said one end of the oblong member and to the throw of said eccentric driving lug being such that with the lock cylinder in its locked position the security bolt is held against retraction from its projected operative position, but when the lock cylinder is turned to an unlocked position its driving lug does not interfere with movement of said axially slidable oblong member to either its retracted or projected positions.

10. The locking device of claim 1, wherein said control member comprises a cylinder rotatably mounted in the base, wherein the drive means operatively connecting said control member with the security bolt comprises an eccentric driving lug projecting from said cylinder into a recess in one side of the security bolt, the dimensions of said recess and its location with respect to the end of the security bolt that is engageable with the shroud and to the throw of said eccentric driving lug being such that in one position of rotation of said cylinder its eccentric driving lug holds the security bolt in its projected operative position, in another position of rotation its driving lug holds the security bolt in its retracted inoperative position, and in a third position of rotation its driving lug does not interfere with motion of the security bolt to either its projected or retracted position, and wherein said control member further comprises a handle at the exterior of the base drivingly connected with said cylinder for imparting rotation thereto.

11. The locking device of claim 5, wherein said drive means that connects said key controlled motion-producing means with the security bolt includes means by which, upon proper actuation of said key controlled motion-producing means, the security bolt maybe locked against retraction.

12. The locking device of claim 1, wherein one end of said guideway opens into an end portion of said round hole in the base, wherein the opposite end of the guideway is closed, wherein said spring means biasing the security bolt towards its operative position is confined between the closed end of the guideway and the adjacent end of the security bolt, and wherein the length of the security bolt does not exceed the diameter of said end portion of the round hole, so that the security bolt can be inserted into the guideway through said end portion of the hole.

* * * * *